US005979858A

United States Patent [19]

Bronson

[11] Patent Number: 5,979,858

[45] Date of Patent: Nov. 9, 1999

[54] COPYHOLDER STAND

[76] Inventor: Myron Bronson, 236 Terre Hill, Cortland, Ohio 44410

[21] Appl. No.: 08/901,179

[22] Filed: Jul. 28, 1997

Related U.S. Application Data

[63] Continuation-in-part of application No. 08/779,984, Dec. 23, 1996, abandoned.

[51] Int. Cl.[6] ..... A47B 97/04

[52] U.S. Cl. ..... 248/452

[58] Field of Search ..... 248/452, 441.1, 248/451, 453, 454, 455, 456; 24/67.9; D6/419, 420; D19/2, 86, 90, 91

[56] References Cited

U.S. PATENT DOCUMENTS

| | | | |
|---|---|---|---|
| D. 219,757 | 7/1969 | Pagano | D19/2 |
| D. 327,172 | 6/1992 | Pagano . | |
| D. 366,568 | 1/1996 | Pagano | D6/419 X |
| 2,274,888 | 3/1942 | Coppock | 248/451 X |
| 2,549,200 | 4/1951 | Hooks | 24/67.9 |
| 3,698,267 | 10/1972 | Denney | 81/185 |
| 3,897,037 | 7/1975 | Johnson et al. | 248/460 |
| 3,945,598 | 3/1976 | Bell | 248/441 X |
| 4,150,807 | 4/1979 | Manso | 248/452 |
| 4,275,863 | 6/1981 | Hartman | 248/448 |
| 4,957,261 | 9/1990 | Cirami | 248/451 X |
| 5,052,650 | 10/1991 | Beile et al. | 248/451 |
| 5,088,677 | 2/1992 | Chandler | 248/451 |
| 5,152,490 | 10/1992 | Deutsch | 248/452 |
| 5,193,420 | 3/1993 | Smith | 81/185 X |
| 5,464,293 | 11/1995 | Hall | 248/441.1 X |
| 5,615,856 | 4/1997 | Simington | 248/452 |
| 5,634,623 | 6/1997 | Hoiijtink | 248/448 |
| 5,746,410 | 5/1998 | Hung | 248/452 X |
| 5,769,369 | 6/1998 | Meinel | 248/176.1 |
| 5,791,209 | 8/1998 | Marks | 81/185 |
| 5,806,385 | 9/1998 | Schupp | 81/185 |
| 5,829,328 | 11/1998 | Chen | 81/185 |

*Primary Examiner*—Ramon O. Ramirez
*Assistant Examiner*—Tan Le
*Attorney, Agent, or Firm*—Carothers & Carothers

[57] ABSTRACT

A copyholder stand having an L-shaped freestanding copy rest with an upright support panel. The inner face of the panel is provided for engaging and supporting upright copy for study or review. A slide clip is slidably receivable over an upper or side edge of the panel for adjustably engaging copy against the inner face of the panel with applied pressure. The legs of the clip are biased to apply pressure toward each other for engaging copy against the support panel. The front arm or arms of the clip provide one or more reference lines for indexing copy indicia. The base of the clip is also provided with an L-shaped overhang that extends over the inner face of the copyholder panel with a distal portion of the overhang extending inwardly for engagement of outer edges of copy resting on the copyholder stand so that the clip overhang will adjustably retain copy on the copy rest.

7 Claims, 3 Drawing Sheets

COPYHOLDER STAND

CROSS REFERENCES

This application is a continuation-in-part of U.S. application Ser. No. 08/779,984 filed Dec. 23, 1996 for COPYHOLDER STAND now abandoned.

BACKGROUND OF THE INVENTION

The present invention pertains generally to copyholders and more particularly to universal copyholders for retaining common side edge bound books, flop over top bound books and papers in general on a rest for hands-off viewing or copy work.

Copyholders presently available on the market include a freestanding rest for supporting papers or a book and additionally usually include a clip mechanism on the back for retaining flipped over pages of a top bound book to maintain the book open to a desired portion of text. However, no adequate means is provided for also retaining the pages of the more common side edge bound book open to a desired portion of text.

It is an object of the present invention to provide a universal copyholder for holding all types of copy, including the capability of holding a side edge bound book open to a desired portion of text in a unique and convenient manner.

SUMMARY OF THE INVENTION

The copyholder stand of the present invention includes an L-shaped freestanding copy rest having an upright panel with an inner face for engaging and supporting upright copy and an outer back face. A slide clip is slidably received over an edge (top or side edge) of the panel for adjustably engaging copy against the interface of the panel with applied pressure.

This clip includes a clip back arm extending from a clip base for engaging the outer back face of the panel and the clip further includes a front arm which extends with the back arm from the clip base for biased applied pressure of the arms toward each other for engaging copy or for merely engaging the back panel without copy therebetween in biased clip engagement.

The clip front arm includes a reference line for indexing copy indicia when the clip is used to retain copy in pressed engagement against the interface of the copyholder stand panel.

The front arm of this slidably adjustable clip may in fact include two front arms that extend from the clip base in spaced parallel alignment with each other to thereby index or reference written copy indicia aligned between the two spaced arms.

This clip is provided with an L-shaped overhang extending over the inner face of the panel with a distal portion of the overhang extending downwardly for engagement or retention of upper edges of copy resting on the rest while the copy is engaging the inner face of the panel to thereby retain copy on the copy rest.

Accordingly, when the copy is in the form of an open side edge bound book resting on the copy rest, the overhang of the clip retains pages of the book open to a desired portion of text, thereby preventing the pages from moving or turning on their own.

The copyholder stand is also provided with an upwardly open spring bias clip on the outer face at the back of the copy rest for receiving and retaining flipped over pages of a top edge bound book which is positioned on the copy rest.

BRIEF DESCRIPTION OF THE DRAWINGS

Other objects and advantages appear in the following description and claims. The accompanying drawings show, for the purpose of exemplification, without limiting the invention or claims thereto, certain practical embodiments of the invention wherein:

DETAILED DESCRIPTION OF A PREFERRED EMBODIMENT

Figure 1:
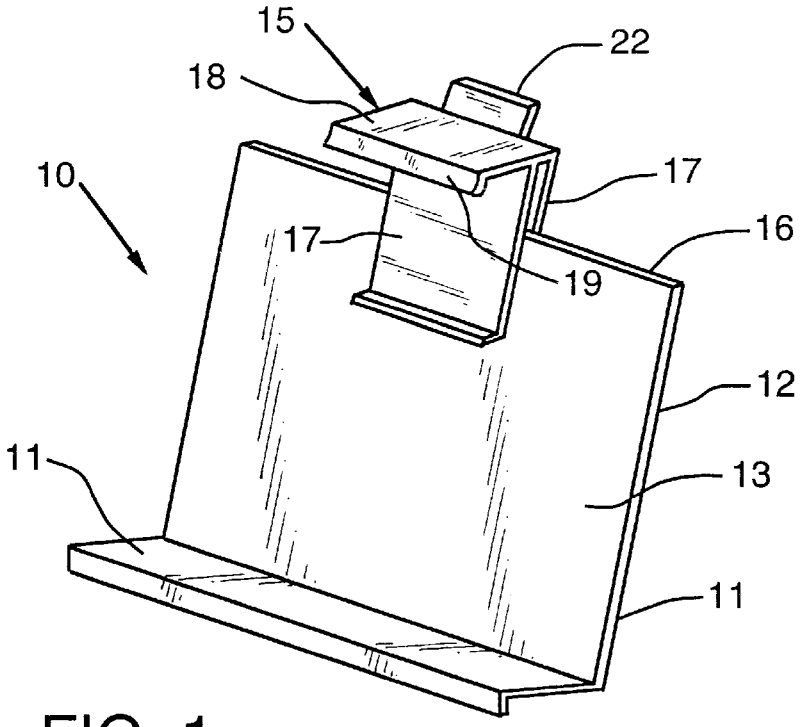
FIG. 1 is a front perspective view of the copyholder stand of the present invention.
Figure 2:
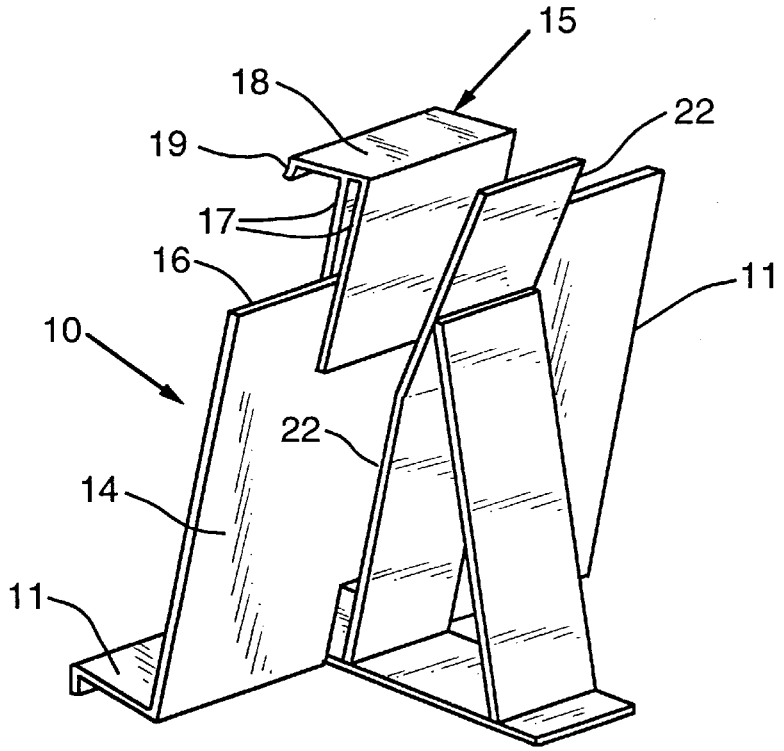
FIG. 2 is a right side back perspective view of the copyholder stand shown in FIG. 1.
Figure 3:
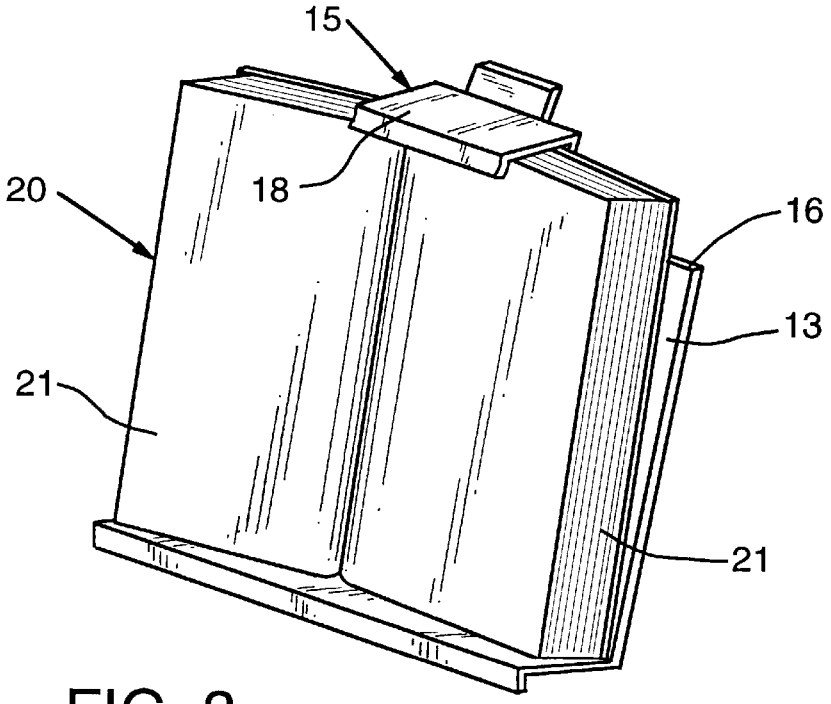
FIG. 3 is a front perspective view of the copyholder shown in FIG. 1 with a side edge bound book retained therein.
Figure 4:
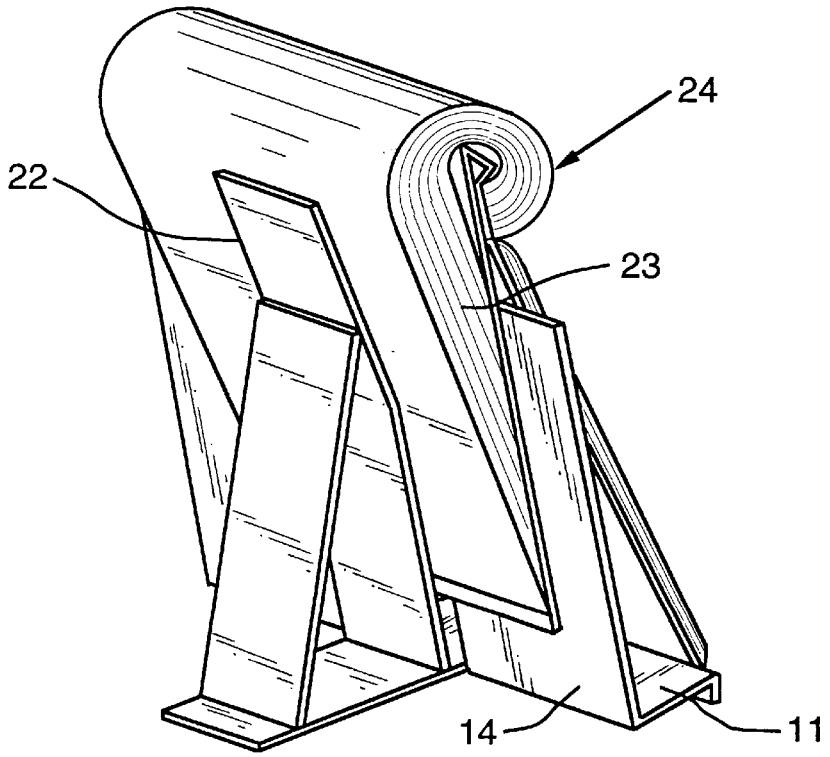
FIG. 4 is a left side rear perspective view of the copyholder stand shown in FIG. 1 with a top edge bound book retained therein.

With reference to FIGS. 1 and 2, the copyholder stand of the present invention includes an L-shaped self-supporting and freestanding copy rest 11 having an upright back panel 12 with an inner face 13 for engaging upright copy thereon (as shown in FIGS. 3 and 4) and an outer face 14.

A slide clip 15 is receivable over upper edge 16 of panel 12 for engaging panel 12 between downwardly depending legs 17 under spring bias whereby clip 15 may be vertically slid on panel 12 to a desired position and there retained by the spring biased grip of legs 17. Legs 17 are spring biased due to converge toward each other in engagement with panel 12 interposed therebetween.

Clip 15 is also provided with an L-shaped overhang 18 which extends over the inner face 13 of panel 12 with a distal portion 19 thereof extending downwardly for engagement of upper edges of copy (see FIGS. 3 and 4) resting on rest 11 whereby the overhang will adjustably retain copy on rest 11. This feature is specifically shown in FIG. 3.

Referring to FIG. 3, copy 20 in the form of an open side edge bound book is resting on copy rest 11 and the overhang 18 of clip 15 retains pages 21 of book 20 open to a desired portion of text so that the pages due to their stiffness cannot accidentally turn on their own. Of course clip 15 may be raised vertically and positioned left or right as required to meet the requirements of books of different size.

Referring next to FIG. 4 and also to FIGS. 1 and 2, the outer face 14 of copy rest 11 is further provided with an upwardly open spring biased clip 22 for receiving and retaining flipped over pages 23 of a top edge bound book 24 positioned as copy on the copy rest 11.

The copy in FIGS. 3 and 4 is illustrated as a book, however, sheet copy may also be supported and retained on the copy rest.

The copyholder stand 10 may be constructed of any suitable material, such as metal or plastic, which is sufficiently stiff, yet flexible enough to provide the spring action required of legs 17 and of clip 22. In this regard, ABS plastic is preferred due to its rigidity with flexibility and ability to withstand a significant amount of abuse.

Figure 5:
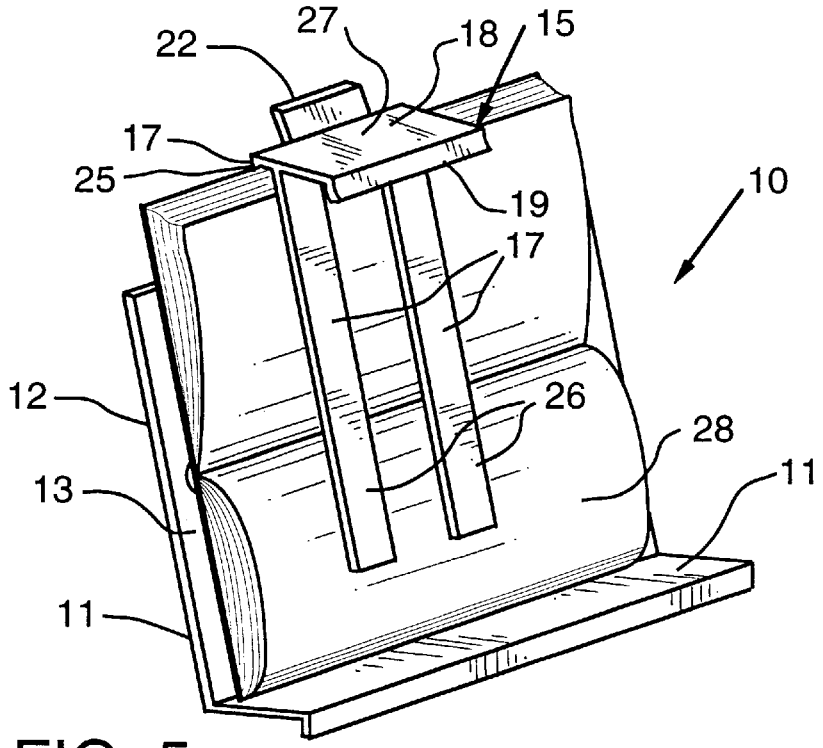
FIG. 5 is a left side front perspective view of the copyholder stand shown in FIG. 1 illustrating another embodiment of the slide clip mechanism used in combination with the copyholder stand.

Referring next to FIG. 5, the copyholder stand is illustrated showing a variation in the construction of slide clip 15. In this embodiment, slide clip 15 still includes an outwardly or downwardly depending front and back legs 17. However, in this embodiment, the back leg 17 is provided in the form of clip back arm 25 that extends outwardly from clip base 27 for engaging the outer face 14 (see FIG. 2) of back panel 12.

In addition, front leg 17 is provided in the form of two clip front arms 26 that extend with back arm 25 from clip base 27 for biased applied pressure of arms 26 and arm 25 toward each other for engaging copy 28 therebetween in biased clip engagement.

The two clip front arms 26 extend from base 27 in spaced parallel alignment with each other as illustrated and the edges thereof are utilized as indicia indexing guidelines for indexing indicia on copy 28. In fact, the spaced gap between inner arms 26 may be utilized to reference or index indicia therebetween.

Alternatively, instead of using an edge of inner arms 26 as a reference line for indexing copy indicia, heavy dark lines may be provided on the transparent plastic inner arms 26 as indicia reference lines.

Figure 6:
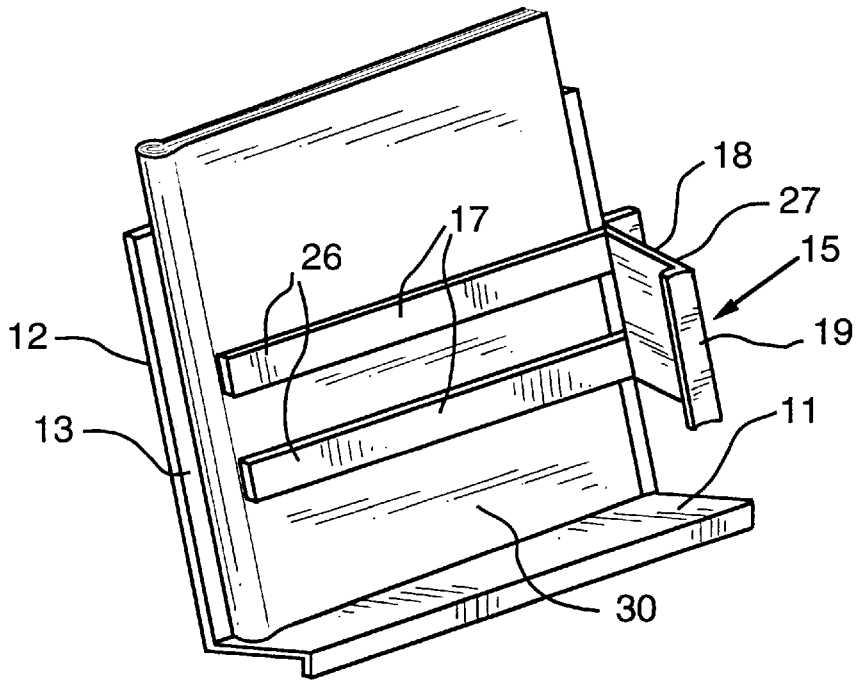
FIG. 6 is a left side front perspective view of the copyholder stand and clip combination shown in FIG. 5 configured together in an alternative relationship for indexing and referencing copy indicia.

Referring next to FIG. 6, the same copyholder and slidably clip combination of FIG. 5 is illustrated, however, slide clip 15 is utilized in a horizontal arrangement with copy stand 10 or back panel 12 in combination with copy 30 which is here provided or shown in the form of a magazine with front pages thereof folded behind.

This embodiment illustrates that the clip may be utilized to use front arms 26 as indicia reference lines with the clip 15 positioned horizontally over copy 30 as well as the previous alternative combination illustrated in FIG. 5 wherein the clip 15 is positioned in vertical fashion relative to the stand 10 or panel 12.

I claim:

1. A copyholder stand comprising an L-shaped freestanding copy rest having an upright support panel with an inner face for engaging and supporting copy in an upright manner and an outer back face;

a slide clip slidably receivable over an edge of said panel for adjustably engaging copy against the inner face of said panel with applied pressure;

said slide clip including a clip base and an elongated clip back arm extending from said clip base a distance sufficient for thereby permitting sliding engagement of a substantial portion of said outer back face of said panel by said elongated clip back arm, and an elongated clip front arm at least coextending with said back arm from said clip base for biased applied pressure of said front and back arms toward each other for engaging copy and/or said upright support panel therebetween in biased clip engagement whereby said clip base may be adjustably slid away toward along an edge of said panel for a distance equal to approximately half the height of said panel;

said clip base further including an L-shaped overhang extending over an inner face of said clip front arm with a distal lip portion thereof spaced from said front arm and extending inwardly from said base with said front arm for engagement by said L-shaped overhang of outer edges of copy resting on said rest against said front arm and said inner face when said clip is engaging said upright support panel whereby said overhang has open ends and has a free interior for adjustably and directly engaging and retaining copy on said copy rest between said distal lip portion and said clip front arm.

2. The copyholder stand of claim 1, wherein said clip front arm includes a reference line for indexing copy indicia.

3. The copyholder of claim 1, said clip front arm including two arms extending from said base in spaced parallel alignment with each other and extending beyond said clip back arm.

4. The copyholder stand of claim 1, wherein said clip front arm extends beyond said clip back arm.

5. The copyholder stand of claim 1 in combination with copy in the form of an open side edge bound book resting on said rest with said overhang of said clip retaining upper edges of pages of said book open to a desired portion of text.

6. The copyholder stand of claim 1, wherein said outer back face of said upright support panel is provided with an upwardly open spring biased clip for receiving and retaining flipped-over pages of a top edge bound book positioned on said copy rest.

7. The copyholder stand of claim 1 wherein said clip front arm is transparent plastic.

* * * * *